US005199230A

United States Patent [19]

Gehman

[11] Patent Number: 5,199,230

[45] Date of Patent: Apr. 6, 1993

[54] VENETIAN BLIND STORAGE ASSEMBLY

[75] Inventor: Dana K. Gehman, Somerset, Pa.

[73] Assignee: Fleetwood Enterprises, Inc., Riverside, Calif.

[21] Appl. No.: 888,891

[22] Filed: May 26, 1992

[51] Int. Cl.[5] ..... E04B 7/16

[52] U.S. Cl. ..... 52/66; 160/34; 160/38; 160/178.1

[58] Field of Search ..... 160/34, 19, 38, 39, 160/178.1; 135/89; 52/66

[56] References Cited

U.S. PATENT DOCUMENTS

| | | | |
|---|---|---|---|
| 761,293 | 5/1904 | Goldsmith | 160/19 |
| 2,590,767 | 3/1952 | Guarino et al. | 160/34 |
| 2,600,083 | 6/1952 | Sutz | 160/34 |
| 2,651,357 | 9/1953 | Skwark | 160/34 |
| 2,653,657 | 9/1953 | Skwark | 160/34 |
| 3,286,414 | 11/1966 | Harrison et al. | 52/66 |
| 3,452,802 | 7/1969 | McMahon | 160/34 |
| 3,519,306 | 7/1970 | Young | 52/66 X |
| 3,996,987 | 12/1976 | Rodriguez | 160/19 |

*Primary Examiner*—David M. Purol
*Attorney, Agent, or Firm*—Price, Gess & Ubell

[57] ABSTRACT

A venetian blind storage assembly for use in storing a venetian blind in a collapsible tent trailer is provided. The assembly includes a venetian blind mounted within a flexible pouch. The assembly is mounted to an interior of the collapsible tent trailer above a window formed in a collapsible side wall of the trailer. The pouch includes a bottom opening extending along the entire length of the venetian blind to allow slats of the venetian blind to be lowered and used as desired while the trailer is expanded. Prior to collapsing the trailer, the slats of the venetian blind are retracted and enclosed within the pouch. The opening of the pouch is shut tightly to completely isolate the venetian blind from the interior of the trailer. Thus, when the trailer is subsequently collapsed into a compact configuration, both the venetian blind and the interior of the trailer are protected from damage.

12 Claims, 2 Drawing Sheets

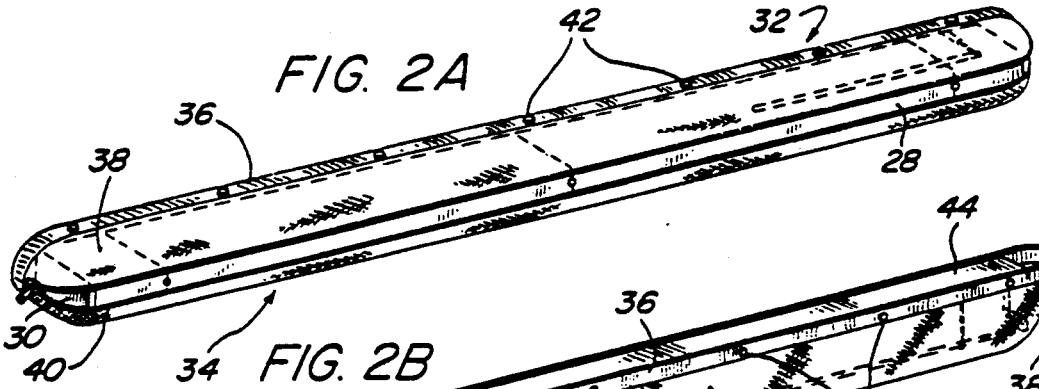
FIG. 2A
42
32
36
38
28
30
40
34
FIG. 2B
44
36
38
42
32
42
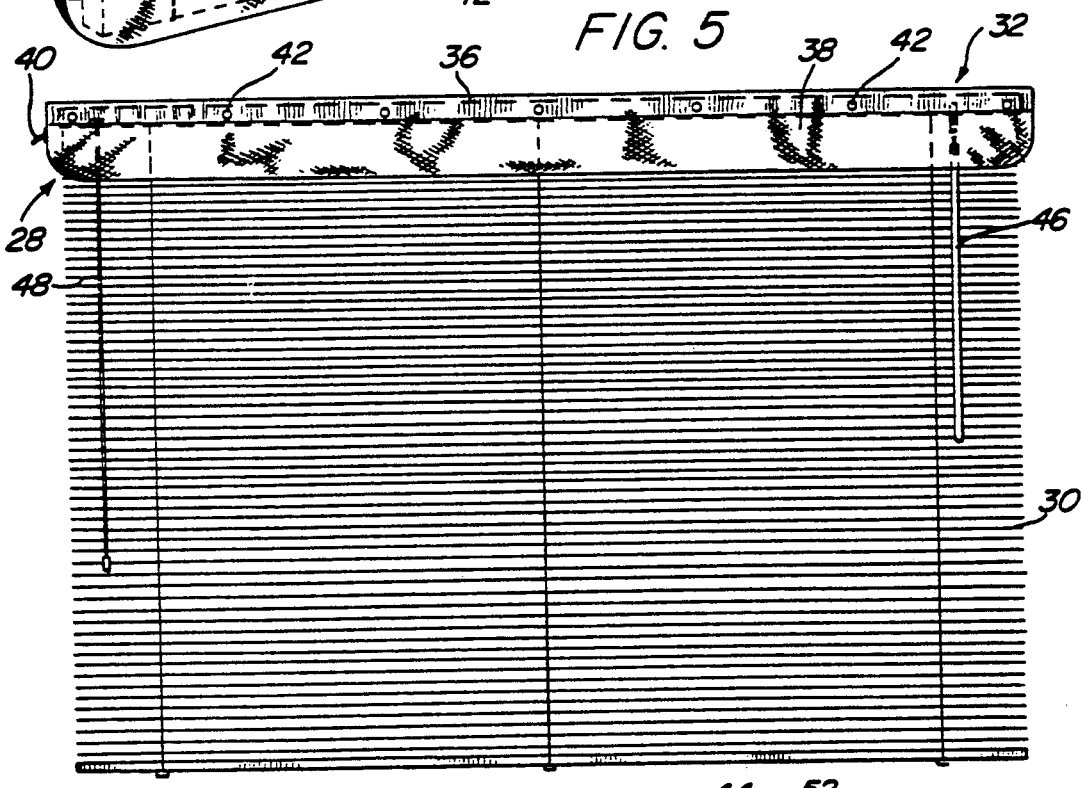
FIG. 5
40
42
36
38
42
32
28
46
48
30
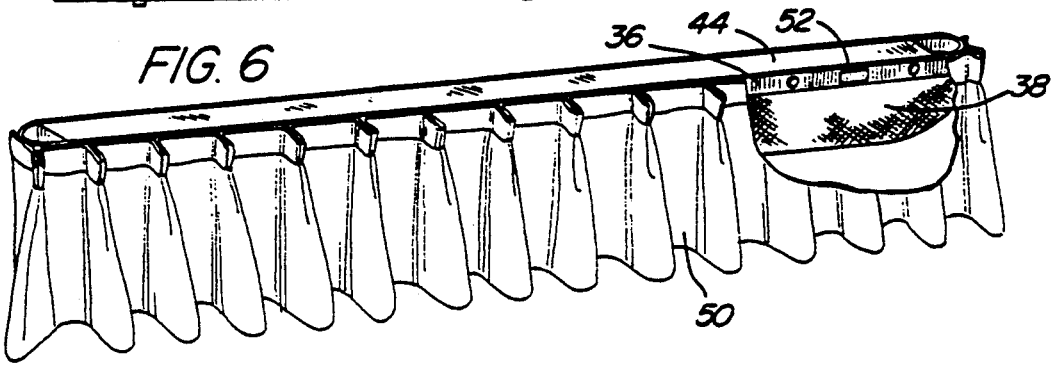
FIG. 6
36
44
52
38
50

VENETIAN BLIND STORAGE ASSEMBLY

BACKGROUND OF THE INVENTION

1. Field of the Invention

The invention relates generally to collapsible tent trailers and, in particular, to a venetian blind storage assembly for use in a collapsible tent trailer.

2. Description of Related Art

The collapsible tent trailer is a popular trailer for use in camping or other outdoor activities. The collapsible tent trailer provides the roominess of a full size camper trailer, yet is much lighter in weight and is collapsible into a compact size for towing.

A conventional collapsible tent trailer includes a base portion having a raiseable and lowerable roof. A set of flexible collapsible walls connect the base to the roof, and a mechanism is provided for raising and lowering the roof. When raised, the flexible, collapsible walls are expanded and become relatively taut to form a set of walls for the camper. When collapsed, the flexible walls collapse into relatively compact bundles which remain between the base and the roof of the trailer. The roof may be securely fastened to the base, thus yielding a compact and generally aerodynamic trailer. The base is provided with a set of wheels and a hitch such that the collapsible tent trailer may be towed behind a truck or other vehicle.

The collapsible walls are formed of a durable, flexible material such as canvas or sturdy plastic. However, portions of the collapsible walls are formed of a generally transparent material to form windows. Typically, the window portion comprises a mesh screen which is sufficiently transparent to form a window, and also allows for ventilation of the interior of the collapsible tent trailer. Although the window portions provide ample light to the interior of the camper trailer, the window portions are not easily blocked for privacy or for blocking incoming light. Hence, it is desirable in a collapsible tent trailer to provide a set of drapes or blinds for covering the window portions to allow the windows to be blocked to ensure privacy or to darken the interior of the trailer.

Heretofore, no adequate blinds have been provided with collapsible tent trailers. Since the collapsible tent trailer is designed for collapsing to a compact trailer, conventional draperies may be crushed and wrinkled. Further, conventional draperies provide a problematic method of privacy. To provide adequate privacy, the conventional draperies must be completely or substantially closed, in which case there is inadequate light and ventilation. If the drapery is left sufficiently open to allow adequate light and ventilation, then inadequate privacy is maintained. A venetian blind, however, provides an adequate degree of privacy. The slats of the venetian blind may be tilted to a desired angle to ensure privacy, yet allow adequate light and ventilation.

A conventional venetian blind assembly provides an attractive alternative to the conventional draperies for the further reason that venetian blinds may be retracted into a compact configuration when not in use. Hence, venetian blinds, when used in a collapsible tent trailer, may be retracted into a compact configuration prior to collapsing the trailer. However, it has been found that a conventional venetian blind assembly is easily damaged when the trailer is collapsed. Further, the slats of the venetian blind assembly may damage the interior of the collapsible tent trailer when the trailer is collapsed. In particular, sharp edges of the slats may puncture the flexible, collapsible walls of the trailer.

Heretofore, no adequate venetian blind assembly has been provided for use within a collapsible tent trailer.

SUMMARY OF THE INVENTION

In view of the foregoing, it should be appreciated that there is a need to provide an improved venetian blind assembly for use in a collapsible tent trailer wherein both the trailer and venetian blind are substantially protected from damage while the trailer is collapsed into a compact configuration.

These and other objects of the invention are achieved by the provision of a venetian blind assembly for use in a collapsible tent trailer wherein the venetian blind assembly includes a pouch for enclosing and protecting the venetian blind while the collapsible tent trailer is collapsed. The pouch is sized to enclose the slats of the venetian blind while the venetian blind is retracted, but is provided with a bottom opening sized to allow the slats of the venetian blind to be extended for use. With the provision of the pouch, the slats of the venetian blind may be completely enclosed and protected by the pouch before the collapsible tent trailer is collapsed such that both the venetian blind and the interior of the trailer are protected. The bottom opening of the pouch, however, allows the venetian blind to be used while the collapsible tent trailer is deployed.

With the provision of the pouch, the venetian blind assembly may be mounted above a window portion of a collapsible wall of the trailer. During use, the slats of the venetian blind may be expanded or contracted as desired and, while expanded, the individual slats of the venetian blind may be tilted as desired. Prior to collapsing the trailer, the venetian blind slats are retracted. The bottom opening of the pouch is closed to isolate the slats of the venetian blind. Then the roof of the trailer is lowered to collapse the trailer into a compact configuration. The pouch thus allows a venetian blind to be conveniently used within a collapsible tent trailer without the need for removing the venetian blind prior to collapsing the trailer and without any substantial risk of damaging either the venetian blind or the interior of the trailer while the trailer is collapsed.

Preferably, the pouch includes a pair of flaps, with each flap being mounted along one side of the head box of the venetian blind. The flaps depend downwardly from the head box of the venetian blinds by a distance sufficient to cover the slats of the venetian blind while the slats are retracted. A zipper is provided along lower edges of the flaps for securing the flaps together to isolate the slats of the venetian blind. Also preferably, a valance is provided for mounting to one of the flaps of the pouch. The valance extends along the length of the pouch and extends below the head box of the venetian blinds by at least the width of the flaps. Hence, the valance obscures the pouch from view such that the venetian blind assembly outwardly appears to be entirely conventional. The combination of the venetian blind and the valance together provide a visual style and sophistication highly desirable within the interior of a collapsible tent trailer.

BRIEF DESCRIPTION OF THE DRAWINGS

The objects and features of the present invention, which are believed to be novel, are set forth with particularity in the appended claims. The present invention, both as to its organization and manner of operation, together with further objects and advantages, may best be understood by reference to the following description, taken in connection with the accompanying drawings.

FIG. 2*a* provides a lower perspective view of the venetian blind assembly of the invention shown with the slats of the venetian blind retracted within an opened pouch;

FIG. 2*b* provides an upper perspective view of the venetian blind assembly of FIG. 2*a*, but showing the pouch closed;

FIG. 5 is a side elevational view of the venetian blind assembly of the invention, shown with the pouch opened and the venetian blind expanded for use;

FIG. 6 is a perspective view of the venetian blind assembly shown retracted in combination with a curtain valance.

DESCRIPTION OF THE PREFERRED EMBODIMENTS

Figures 1, 3, 4, 7:
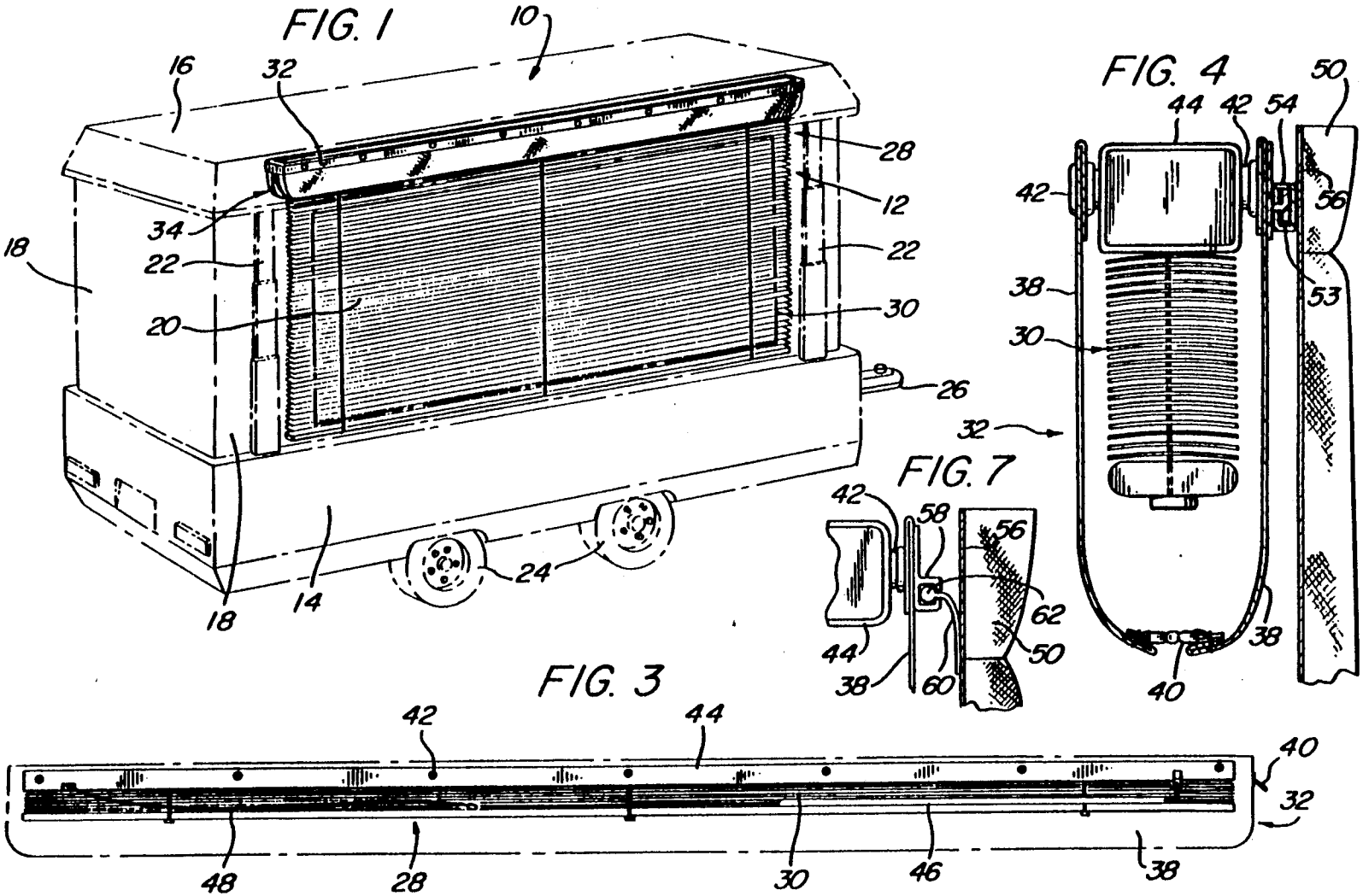
FIG. 1 provides a perspective view of a collapsible tent trailer provided with an interior mounted venetian blind assembly constructed in accordance with a preferred embodiment of the invention with the trailer shown in phantom lines.
FIG. 3 is a side elevational view of the venetian blind assembly of FIG. 2*a* with the pouch closed, and showing the pouch in phantom lines.
FIG. 4 is a cross-sectional view of the venetian blind assembly of FIG. 3, showing the venetian blind assembly retracted for storage and showing a portion of a valance mounted thereto.
FIG. 7 is a cross-sectional view of an alternative embodiment of the venetian blind assembly and valance of FIG. 4.

The following description is provided to enable any person skilled in the art to make and use the invention and sets forth the best modes contemplated by the inventor of carrying out the invention. Various modifications, however, will remain readily apparent to those skilled in the art, since the generic principles of the present invention have been defined herein specifically to provide a venetian blind assembly for use in a collapsible tent trailer.

Referring to the figures, a preferred embodiment of the invention will now be described. In FIG. 1, a collapsible tent trailer 10 is shown in phantom lines. A venetian blind assembly 12 mounted to an interior of collapsible tent trailer 10 is shown in solid lines.

Collapsible tent trailer 10 includes a rigid base 14, a rigid roof 16, and a set of flexible, collapsible walls 18 connecting the base to the roof. Flexible walls 18 are constructed of a durable, flexible material such as canvas. A portion of flexible wall 18 is at least partially transparent and forms a window 20. Preferably, window 20 comprises a flexible screen which allows light and air to enter the interior of collapsible tent trailer 10.

A set of telescoping supports 22 is provided with one support at each corner of the trailer. Telescoping supports 22 mount roof 16 to base 14 and allow roof 16 to be raised or lowered with respect to base 14. A means such as a jack (not shown) is operably connected to the telescoping supports to expand or contract the supports as desired to raise or lower roof 16. While in the raised configuration shown in FIG. 1, flexible walls 18 are stretched relatively taut to provide side walls to the collapsible tent trailer. To collapse the trailer, telescoping supports 22 are retracted, thus lowering roof 16 until it rests directly on base 14. As roof 16 is lowered, flexible walls 18 collapse into a relatively compact bundle which remains within the interior of trailer 10. A set of latches (not shown) or other fastening devices may be provided for securing roof 16 onto base 14 in the collapsed configuration. A set of wheels 24 and a towing hitch 26 are provided to allow the trailer to be towed in its collapsed state. The collapsed configuration is not shown in the drawings.

Venetian blind assembly 12 mounts to an interior side surface of roof 16. Venetian blind assembly 12 includes a venetian blind 28, which includes a set of parallel horizontal slats 30 which may be raised or lowered, and a pouch 32 for enclosing venetian blind 28 while slats 30 are collapsed. Pouch 32 includes a bottom closable opening 34 which, when opened, is sufficiently large to allow slats 30 to depend from pouch 32 as shown in FIG. 1. However, when slats 30 are retracted into a compact configuration, opening 34 may be closed to isolate slats 30 within pouch 32.

In use, prior to collapsing trailer 10 from the expanded configuration of FIG. 1 to a collapsed configuration, slats 30 of venetian blind 28 are raised and retracted to lie within pouch 32. Then opening 34 is closed to completely isolate slats 30 from the interior of trailer 10. Roof 16 is lowered as described above to collapse trailer 10 into a compact configuration. With pouch 32 enclosing and protecting venetian blind 28, slats 30 are protected from any possible damage which may occur while trailer 10 is collapsed. Further, interior surfaces of trailer 10, such as flexible walls 18, are protected from being punctured or torn by sharp edges of slats 30.

To redeploy trailer 10, roof 16 is raised from base 14 to the configuration shown in FIG. 1. Then, opening 34 of pouch 32 may be opened, thus allowing slats 30 of venetian blind 28 to be lowered and used as desired. The specific configuration of pouch 32 will be described in detail with reference to the remaining figures.

FIGS. 2*a* and 2*b* provide perspective views of pouch 32 mounted to venetian blind 28. In FIGS. 2*a* and 2*b*, venetian blind 28 is shown in a retracted configuration with slats 30 drawn together. Pouch 32 includes a reinforcing band 36 and a pair of side flaps 38. Reinforcing band 36 is a generally thin and narrow oval band sewn around the periphery of pouch 32 in the vicinity of a head box 44 of venetian blind 28 for reinforcing the pouch.

Flaps 38 depend from opposing sides of venetian blind 28 by a sufficient distance to extend below the slats of the venetian blind 28 when venetian blind 28 is fully retracted. A closure mechanism such as a zipper 40 is provided along lower edges of flaps 38 to allow the flaps to be secured together along the entire length of venetian blind 28. When unzipped, lower edges of flaps 38 form opening 34, which allows venetian blind 28 to be expanded for use. When zipped shut, flaps 38 and band 36 form a pouch which isolates the slats of venetian blind 28 from the interior of the collapsible tent trailer. Pouch 32 is shown in its closed configuration in FIG. 2*b*.

A set of mounting rivets 42 is provided around pouch 32 through reinforcing band 36 for securing pouch 32 to head box 44 of venetian blind 28. Preferably, the rivets extend through reinforcing band 36 of pouch 32 to permanently secure pouch 32 to head box 44.

In the embodiment of pouch 32 shown in the drawings, a top portion of head box 44 of the venetian blind remains exposed through a top opening in the pouch. The top opening in the pouch is provided to facilitate mounting the pouch to the venetian blind. In an alternative embodiment (not shown), a pouch may be provided without a top opening.

FIG. 3 provides a side view of venetian blind assembly 12 showing how venetian blind 28 fits within pouch 32. As can be seen from FIG. 3, slats 30 are compacted together in a close parallel configuration. A tilt wand 46, provided for tilting slats 30 while slats 30 are expanded, is folded sideways and held within pouch 32. Likewise, a lift cord 48, provided for raising and lowering slats 30, is held within pouch 32. Tilt wand 46 and lift cord 48 are secured within pouch 32 by closed flaps 38. In the drawings a venetian blind is shown having tilt wand 46 and lift cord 48 positioned on opposing ends of venetian blind 28. Other conventional blinds have the tilt wand and lift cord positioned on the same end.

As can be seen from FIG. 3, side flaps 38 are of a sufficient width to fully enclose slats 30, tilt wand 46, and lift cord 48.

The collapsed, enclosed configuration of venetian blind assembly 12 is shown in cross-section in FIG. 4, excluding tilt wand 46 and lift cord 48. As can be seen from FIG. 4, the interior of pouch 32 is somewhat larger than the retracted venetian blind shown in the figures. This allows pouches of a single size to fit over any of a number of differently-sized venetian blinds. FIG. 4 also shows a portion of a valance 50 described in detail below with reference to FIGS. 6 and 7.

The expanded configuration of venetian blind assembly 12 is shown in FIG. 5. As can be seen from FIG. 5, slats 30, tilt wand 46, and lift cord 48 are extended for use. Flaps 38 are opened, allowing unhindered use of slats 30. In the configuration of FIG. 5, slats 30 may be tilted by a desired amount by tilt wand 46, or may be raised or lowered a desired amount by lift cord 48. Thus, with venetian blind assembly 12 mounted to the interior of collapsible tent trailer 10, slats 10 may be adjusted to block light from entering the interior of the trailer through window portion 20, or may be partially or completely opened to allow a desired amount of light and air to enter trailer 10. Venetian blind 28 may be of entirely conventional construction.

Venetian blind 28 thus provides a convenient and easy-to-use means for blocking or closing window portions 20 of collapsible tent trailer 10. Further, venetian blind 28 provides a degree of visual style and sophistication to the interior of trailer 10. A valance 50, shown in FIG. 6, may additionally be provided. As shown in FIG. 6, valance 50 mounts to reinforcing band 36 along the entire length of venetian blind 28. A curtain portion of valance 50 hangs down from reinforcing band 36 to completely cover flaps 38. Valance 50 thus obscures pouch 32 from view, such that venetian blind assembly 12 outwardly appears to be entirely conventional. Valance 50 further improves the visual style of the interior of trailer 10. In this regard, valance 50 may be formed of a fabric and color chosen to complement venetian blind 28 and the remainder of trailer 10.

A set of strips of engaging hook-and-clasp members 52, such as those marketed under the trade name Velcro®, may be used for attaching valance 50 to pouch 32 through reinforcing band 36. However, a variety of other suitable mounting mechanisms may be used, such as hooks, clasps, or rivets.

Two such alternative mounting mechanisms are shown in FIGS. 4 and 7. In FIG. 4, valance 50 is shown mounted to a side flap 38 of pouch 32. An I beam track 53 is mounted directly to side flap 38 by rivet 42. A rear surface of valance 50 is provided with a C-shaped track 54 mounted to a rear portion 56 of valance 50. I beam track 53 and C-shaped track 54 extend along an entire side length of pouch 32. As can be seen from FIG. 4, I beam track 53 engages with C-shaped track 54 to mount valance 50 to the venetian blind assembly. To remove valance 50, one merely slides the valance laterally with respect to the venetian blind assembly to disengage C-shaped slot 54 from I beam track 53. In a possible alternative embodiment, rather than providing a single long set of tracks, a plurality of individual tracks are provided along venetian blind assembly 32.

An alternative mounting mechanism is shown in FIG. 7. In the embodiment of FIG. 7, a C-shaped track 58 is provided mounted to flap 38 via rivet 42. A flexible tab 60 having an enlarged end 62 is sewn onto rear portion 56 of valance 60. Enlarged end 62 of flexible tab 60 engages within C-shaped track 58. As with the embodiment of FIG. 4, the C-shaped track extends along the entire side length of the venetian blind assembly. To mount or remove valance 50, one merely slides enlarged end 62 of flexible tab 60 within C-shaped slot 58.

Pouch 32 may be constructed of any suitable durable material, such as a sturdy, flexible nylon or vinyl fabric. Although shown in the drawing as covering only the sides and bottom of venetian blind 28, pouch 32 may alternatively close the entire venetian blind. Also, although shown as being closed by a zipper, flaps 38 may be closed by any of a variety of means such as rivets, clasps, or hooks.

Those skilled in the art will appreciate that various adaptations and modifications of the just-described preferred embodiment can be configured without departing from the scope and spirit of the invention. Therefore, it is to be understood that, within the scope of the appended claims, the invention may be practiced other than as specifically described herein.

What is claimed is:

1. A venetian blind assembly for use in a collapsible tent trailer, comprising:
   - a venetian blind;
   - means for mounting the venetian blind to an interior of the collapsible tent trailer;
   - a pouch enclosing slats of the venetian blind, the pouch being sized to enclose the slats while the venetian blind is retracted and having a bottom opening sized to allow the slats of the venetian blind to extend downwardly from the pouch while the venetian blind is expanded, and
   - closure means for closing the bottom opening of the pouch while the venetian blind is retracted.

2. The venetian blind assembly of claim 1, wherein the pouch comprises a pair of flaps, with means for mounting inner sides of top edges of the flaps to opposing outer sides of a head box of the venetian blind, each flap being slightly longer than the head box of the venetian blind, opposing ends of the flaps being connected together across opposing ends of the head box, and bottom edges of the flaps together forming the bottom opening.

3. The venetian blind assembly of claim 1, wherein the closure means comprises a zipper extending along the pouch between opposing ends of the bottom opening of the pouch.

4. The venetian blind assembly of claim 1, wherein the pouch is sized to enclose the slats of the venetian blind while the venetian blind is retracted with sufficient room remaining to also enclose a pull-cord and tilt wand of the venetian blind.

5. The venetian blind assembly of claim 1, further including a valance mounted to, and depending from, a forward outer side of the pouch.

6. The venetian blind assembly of claim 5, further including means for detachably mounting the valance to the pouch.

7. The venetian blind assembly of claim 6, wherein the means for detachably mounting the valance to the pouch comprises a plurality of strips of engaging hook and clasp members mounted to an exterior forward outer surface of the pouch and to an interior surface of the valance.

8. The venetian blind assembly of claim 5, wherein the valance is sized to cover the pouch.

9. The venetian blind assembly of claim 6, wherein the means for detachably mounting the valance to the pouch comprises an I beam track mounted to the pouch and an engaging C-shaped track mounted to the valance, the C-shaped slot being sized to closely receive the I beam track for securely and slidably mounting the valance to the pouch.

10. The venetian blind assembly of claim 6, wherein the means for detachably mounting the valance to the pouch comprises a C-shaped track mounted to the pouch and a flexible mounting tab member mounted along a rear surface of the valance, the C-shaped slot of the pouch being sized to closely receive an enlarged end portion of the flexible tab member to slidably mount the valance to the pouch.

11. A venetian blind assembly comprising:

a collapsible tent trailer having a window;

a venetian blind mounted to an interior wall of the collapsible tent trailer above the window of the trailer;

a pouch enclosing slats of the venetian blind, the pouch being sized to enclose the slats while the venetian blind is retracted and having a bottom opening sized to allow the slats to extend from the pouch while the venetian blind is extended, and closure means for closing the bottom opening of the pouch to allow the venetian blind to be isolated from the camper while the collapsible tent trailer is collapsed.

12. In a collapsible tent trailer having a ceiling, a base, and at least one wall with a window, and having means for collapsing the ceiling and wall downwardly toward the base, the improvement comprising:

a venetian blind assembly mounted to an interior surface of the wall above the window, said assembly having a venetian blind with a plurality of slats, the venetian blind being reconfigurable between a retracted position wherein the slats of the venetian blind assembly are retracted together and an expanded position wherein the slats of the venetian blind cover a portion of the window;

a pouch member of the venetian blind assembly for enclosing the slats of the venetian blind, the pouch being sized to enclose the slats while the venetian blind is in the retracted position and having a bottom opening sized to allow the slats of the venetian blind to extend downwardly from the pouch while the venetian blind is in the open position, and a closure mechanism for closing the bottom opening of the pouch while the venetian blind is in the retracted position.

* * * * *